US008767371B2

(12) United States Patent
Tanaya

(10) Patent No.: US 8,767,371 B2
(45) Date of Patent: Jul. 1, 2014

(54) IGNITION APPARATUS

(75) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/493,447

(22) Filed: Jun. 11, 2012

(65) Prior Publication Data

US 2013/0208394 A1 Aug. 15, 2013

(30) Foreign Application Priority Data

Feb. 9, 2012 (JP) ..... 2012-025746

(51) Int. Cl.
*F02P 15/10* (2006.01)
*F02P 3/04* (2006.01)

(52) U.S. Cl.
USPC ..... 361/253; 361/263; 313/338

(58) Field of Classification Search
CPC ..... F02P 15/10; F02P 3/04; F02P 9/007
USPC ..... 361/263, 253; 313/338
See application file for complete search history.

(56) References Cited

U.S. PATENT DOCUMENTS

| | | | | | |
|---|---|---|---|---|---|
| 2,721,959 | A | * | 10/1955 | Nessel | 315/234 |
| 2,963,620 | A | * | 12/1960 | Knudson et al. | 315/35 |
| 2,963,624 | A | * | 12/1960 | Meyer, Jr. et al. | 315/209 CD |
| 3,771,006 | A | * | 11/1973 | Berry | 313/118 |
| 3,894,273 | A | * | 7/1975 | Newport et al. | 361/256 |
| 4,103,659 | A | * | 8/1978 | Donigian | 123/655 |
| 5,193,514 | A | | 3/1993 | Kobayashi et al. | |
| 7,353,813 | B2 | | 4/2008 | Shiraishi | |
| 8,260,529 | B2 | | 9/2012 | Tanaya | |
| 2006/0201475 | A1 | | 9/2006 | Shiraishi | |
| 2010/0259172 | A1 | | 10/2010 | Nakano et al. | |
| 2011/0247598 | A1 | | 10/2011 | Tanaya | |

FOREIGN PATENT DOCUMENTS

| | | | |
|---|---|---|---|
| JP | 52-15935 | | 2/1977 |
| JP | 57-2586 | U | 1/1982 |
| JP | 3-105072 | A | 5/1991 |
| JP | 5-180134 | A | 7/1993 |
| JP | 2006-250099 | A | 9/2006 |
| JP | 2010-096128 | A | 4/2010 |
| JP | 2010-257949 | A | 11/2010 |
| JP | 2011-220168 | A | 4/2011 |

OTHER PUBLICATIONS

Japanese Office Action dated Feb. 5, 2013, issued in Japanese Patent Application No. 2012-025746.

* cited by examiner

*Primary Examiner* — Rexford Barnie
*Assistant Examiner* — Zeev V Kitov
(74) *Attorney, Agent, or Firm* — Sughrue Mion, PLLC

(57) ABSTRACT

An ignition apparatus is provided with an ignition plug (101) including a first electrode (101*a*) that generates a high voltage by means of energy supplied by an ignition coil device (102), a second electrode (101*b*) that faces the first electrode (101*a*) through a first gap and causes in the first gap a spark discharge for igniting a fuel, and a third electrode (101*c*) that faces the first electrode through a second gap that is smaller than the first gap, and is connected with the second electrode (101*b*) by way of an electric conductor (302) having a predetermined resistance value; a control apparatus drives the ignition coil device (102) twice or more times in a single ignition process so that the ignition plug causes a spark discharge.

8 Claims, 5 Drawing Sheets

IGNITION APPARATUS

BACKGROUND OF THE INVENTION

1. Field of the Invention

The present invention relates to an ignition apparatus that is utilized mainly in an internal combustion engine.

2. Description of the Related Art

In recent years, the issues such as environment preservation and fuel depletion have been raised; measures for these issues are urgently required also in the automobile industry. The measures include, as an example, operation of an internal combustion engine through stratified lean combustion, which is ultra-lean combustion that utilizes a stratified air-fuel mixture. In the stratified lean combustion, the distribution of inflammable fuel-air mixtures may vary; therefore, an ignition apparatus capable of absorbing this variation is required.

A conventional ignition apparatus disclosed in Patent Document 1 is provided with an ignition plug that produces a spark discharge in a combustion chamber and a microwave generation apparatus that supplies energy to the spark discharge produced in the ignition plug. It is alleged that because the conventional ignition apparatus makes it possible to form larger discharge plasma, a great number of spatial igniting opportunities can be provided, the variation in the distribution of fuel-air mixtures can be absorbed, and the foregoing requirement on stratified lean combustion is satisfied.

PRIOR ART REFERENCE

Patent Document

[Patent Document 1] Japanese Patent Application Laid-Open No. 2010-96128

The conventional ignition apparatus disclosed in Patent Document 1 can prevent extinction and can suppress the variation in the torque to be produced because it can form large discharge plasma; however, because a path for introducing a microwave is required in addition to an ignition plug, it is difficult to apply the ignition apparatus disclosed in Patent Document 1 to an existing internal combustion engine. There has been a problem that in terms of matching in impedance, technology, and product, it is very difficult to stably supply high-frequency energy such as a microwave into an extremely unstable combustion chamber in which a piston reciprocates, a large pressure change is recurrently caused, and production and extinction of plasma are repeated through discharge and combustion.

SUMMARY OF THE INVENTION

The present invention has been implemented in order to solve the foregoing problems in conventional ignition apparatuses; the objective thereof is to provide an ignition apparatus that is simply configured and is capable of forming large discharge plasma.

An ignition apparatus according to the present invention is provided with an ignition plug that causes a spark discharge for igniting a fuel, an ignition coil device that supplies the ignition plug with energy for causing the spark discharge, and a control apparatus that drives the ignition coil device; in the ignition apparatus, the ignition plug includes a first electrode that generates a high voltage by means of energy supplied by the ignition coil device, a second electrode that faces the first electrode through a first gap and causes in the first gap a spark discharge for igniting the fuel, and a third electrode that faces the first electrode through a second gap that is smaller than the first gap, and is connected with the second electrode by way of an electric conductor having a predetermined resistance value; and the ignition apparatus is characterized in that the control apparatus drives the ignition coil twice or more times in a single ignition process.

In the ignition apparatus according to the present invention, a great deal of plasma produced by a large discharge current can be supplied to the gap between the electrodes of the ignition plug repeatedly and from a spatially wide area; therefore, large discharge plasma can readily be formed with a simple configuration, whereby lean fuel or diluted fuel can stably be combusted. As a result, because the fuel utilized for the operation of an internal combustion engine or the like can drastically be reduced, the carbon footprint can largely be decreased, whereby the ignition apparatus can contribute to the environment preservation.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
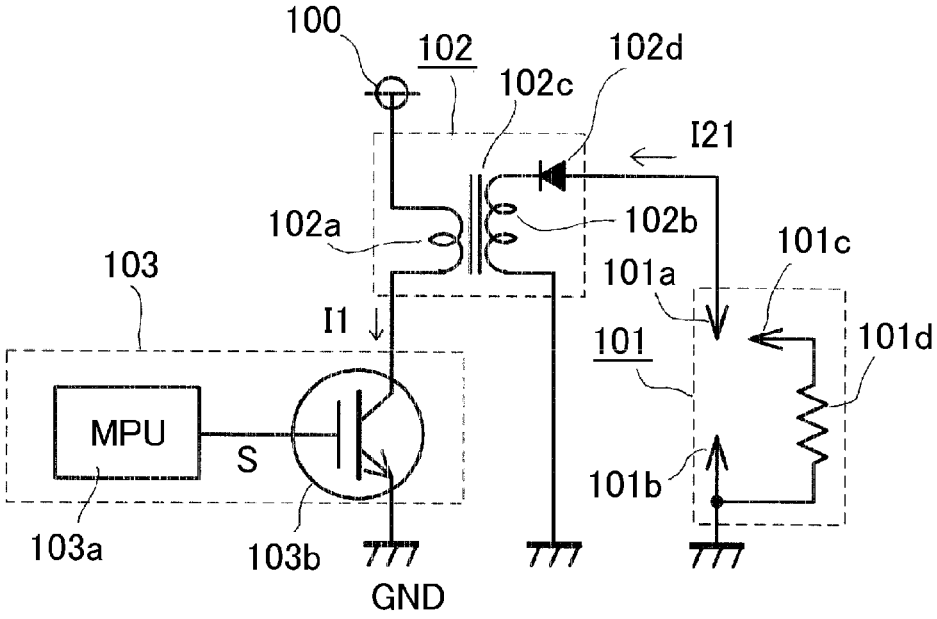
FIG. 1 is a configuration diagram of an ignition apparatus according to Embodiment 1 of the present invention.

FIG. 1 is a configuration diagram of an ignition apparatus according to Embodiment 1 of the present invention. In FIG. 1, an ignition apparatus according to Embodiment 1 of the present invention is provided with an ignition plug 101, an ignition coil device 102 that applies a predetermined high voltage and supplies a current to the ignition plug 101, and a control apparatus 103 that controls the operation of the ignition coil device 102.

The ignition plug 101 is provided with a high-voltage electrode 101*a*, as a first electrode; an external electrode 101*b*, as a second electrode, that faces the high-voltage electrode 101*a* through a main plug gap, which is a first predetermined gap; and a pilot electrode 101*c*, as a third electrode. The pilot electrode 101*c* is connected with the external electrode 101*b* by way of a resistance component 101*d* and faces the high-voltage electrode 101*a* through an auxiliary plug gap, which is a second predetermined gap.

The ignition coil device 102 has a primary coil 102*a* and a secondary coil 102*b*, which are magnetically coupled with each other through an iron core 102*c*, and a rectifier diode 102*d*. The control apparatus 103 is configured with a signal generator 103*a* that generates a control signal S for setting the operation timing and the number of operations of the ignition coil device 102, in accordance with the operation status of an internal combustion engine; and a switching device 103*b* that is switching-controlled by the control signal S supplied from the signal generator 103*a* so as to control a current that flows in the primary coil 102*a* of the ignition coil device 102.

In the ignition apparatus according to Embodiment 1 of the present invention, the signal generator 103*a* is formed of a microprocessor (referred to as an MPU, hereinafter), and the switching device 103*b* is formed of an IGBT.

One end of the secondary coil 102*b* of the ignition coil device 102 is connected with the high-voltage electrode 101*a* of the ignition plug 101 by way of the rectifier diode 102*d*, and the other end thereof is connected with the ground potential (referred to as the GND, hereinafter) of an vehicle.

Figure 2:
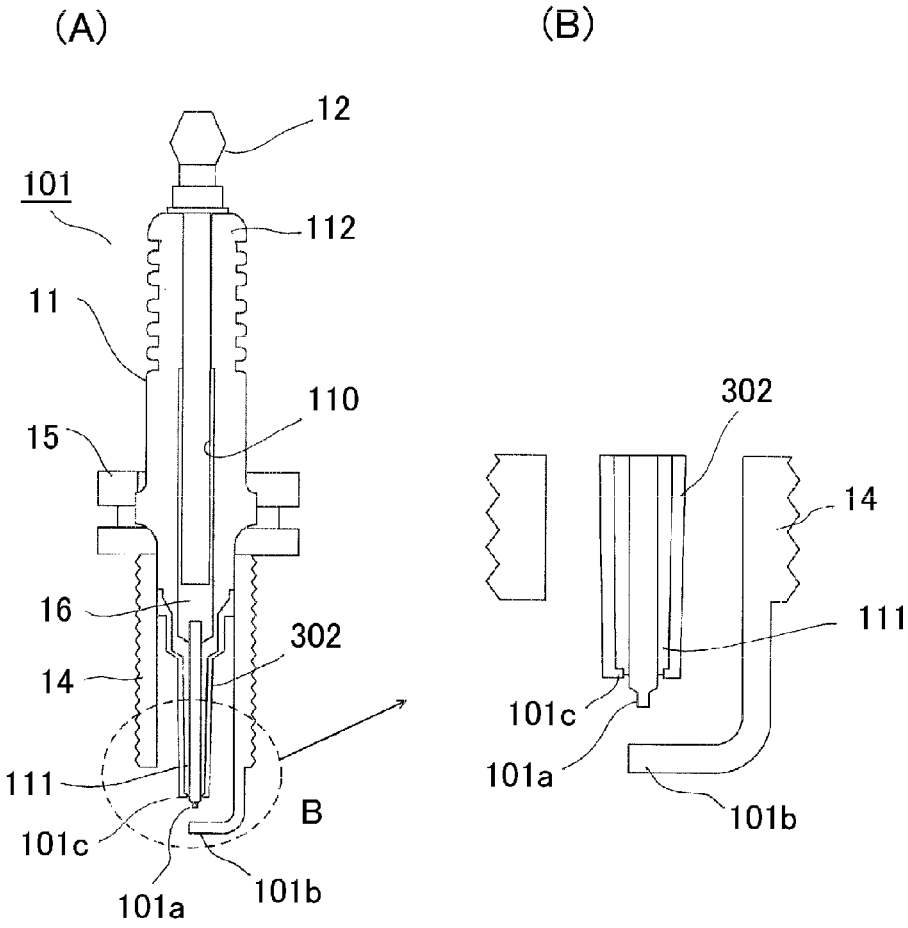
FIG. 2 is a set of cross-sectional views illustrating an ignition plug according to Embodiment 1 of the present invention.

Next, the configuration of the ignition plug 101 will be explained. FIG. 2 is a set of cross-sectional views illustrating an example of ignition plug of an ignition apparatus according to Embodiment 1 of the present invention; FIG. 2(A) is a longitudinal cross-sectional view of an overall ignition plug; FIG. 2(B) is an enlarged cross-sectional view of portion B in FIG. 2(A). In FIG. 2, the ignition plug 101 is provided with an insulator portion 11 formed of ceramics or the like, a terminal portion 12, a filling material 16 having a resistance component, the high-voltage electrode 101*a*, as a first electrode, the external electrode 101*b*, as a second electrode, the high-voltage electrode 101*a*, as a third electrode, a screw portion 14, and a housing portion 15.

The insulator portion 11 is provided with a center hole 110 and is formed in the form of a tube, one end 111 of which is thinner than the other end 112. The terminal portion 12 is inserted into the center hole 110 of the insulator portion 11; one end of the terminal portion 12 is exposed from the other end 112 of the insulator portion 11. The high-voltage electrode 101*a* is inserted into the center hole 110 in the one end 111 of the insulator portion 11; one end of the high-voltage electrode 101*a* is exposed from the one end 111 of the insulator portion 11. The external electrode 101*b* is formed in such a way as to be integrated with the screw portion 14 and faces the front end portion of the high-voltage electrode 101*a* through the main plug gap, which is the first predetermined gap. Inside the center hole 110, the other end of the high-voltage electrode 101*a* and the other end of the terminal portion 12 are electrically connected with each other by means of the filling material 16.

The pilot electrode 101*c* is formed of an electric conductor 302 having a resistance component and is adhered to the outer circumferential surface of the one end 111 of the insulator portion 11. The pilot electrode 101*c* surrounds the outer circumferential surface of one end of the high-voltage electrode 101*a* and faces the high-voltage electrode 101*a* through the auxiliary plug gap, which is the second predetermined gap. The other end of pilot electrode 101*c* is electrically connected with the inner circumferential surface of the screw portion 14 and is electrically connected with the external electrode 101*b* by the intermediary of the screw portion 14. The auxiliary plug gap, which is a gap between the high-voltage electrode 101*a* and the pilot electrode 101*c*, is set in such a way that the pilot electrode 101*c* does not make contact with the high-voltage electrode 101*a* and in such a way as to be narrower than the main plug gap, which is the gap between the high-voltage electrode 101*a* and the external electrode 101*b*.

A housing portion 15 made of metal is fixed to the outer circumferential surface of the insulator portion 11; the outer circumference of the housing portion 15 is formed in the shape of a hexagon or a quadrangle. The housing portion 15 serves as a nut for mounting the ignition plug 101 in the screw portion of a through-hole provided in a cylinder block (unillustrated) of the internal combustion engine or removing the ignition plug 101 from the screw portion, and plays a role of stably fixing the ignition plug 101 to the cylinder block.

The ignition plug 101, configured in such a way as described above, according to Embodiment 1 of the present invention is fixed to a cylinder block of an internal combustion engine (unillustrated), in such a way that the screw portion 14 thereof is screwed into the screw portion provided in the cylinder block of the internal combustion engine and the housing portion 15 makes contact with the cylinder block of the internal combustion engine. The terminal portion 12 of the ignition plug 101 is connected with the secondary coil 102*b* of the ignition coil device 102 by way of the foregoing rectifier diode 102*d*.

The ignition plug 101, configured in such a way as described above, according to Embodiment 1 of the present invention requires no dedicated external terminal for the pilot electrode 101*c* and can be utilized in such a way as to be directly connected with a normal ignition coil device.

Because the ignition plug 101 according to Embodiment 1 of the present invention has the pilot electrode 101*c*, the "required voltage", which is required for causing a dielectric breakdown in the main plug gap, can be reduced. In other words, assuming that a common ignition plug with no pilot electrode has a main plug gap whose gap size is the same as that of the ignition plug according to Embodiment 1 of the present invention, the ignition plug according to Embodiment 1 of the present invention can make it possible to lower the foregoing required voltage to a value as large as half of the required voltage for the common ignition plug.

It is ideal that the resistance value of the resistance component 101*d* that connects the pilot electrode 101*c* with the external electrode 101*b*, i.e., the resistance value of the resistance component of the electric conductor 302 that forms the pilot electrode 101*c* illustrated in FIG. 2 is determined in accordance with the foregoing required voltage that varies based on the operation status of the internal combustion engine; however, in that case, because an external terminal dedicated to the pilot electrode 101*c* is required, the structure of the ignition plug becomes complex. However, if the objective is limited to a restricted application such as reducing the maximum value of the foregoing required voltage in a common automobile equipped with an internal combustion engine utilizing gasoline as a fuel, the objective can be realized by setting the resistance value of the resistance component 101*d* to a fixed value of approximately 300 [kΩ]; thus, there can be demonstrated an effect that the required voltage for causing a dielectric breakdown in the main plug gap is lowered with a simple configuration.

If the objective is to lower the foregoing required voltage in the case where the ambient pressure inside the cylinder is lower than the atmospheric pressure, the objective can most efficiently be realized by setting the resistance value of the resistance component 101*d* to approximately 50 [kΩ]. If the objective is to lower the foregoing required voltage under a high-pressure condition where the ambient pressure inside the cylinder is the same as or higher than 10 atmospheres, the objective can be realized by setting the resistance value of the resistance component 101*d* to approximately 1 [MΩ].

As described above, by use of the ignition plug 101 having the pilot electrode 101*c*, the required voltage for causing a dielectric breakdown in the main plug gap can almost be halved; therefore, the ignition coil device 102 can be configured not with a conventional voltage-oriented specification but with a current-oriented specification, for example, with a specification in which the turn ratio of the secondary coil 102*b* to the primary coil 102*a* is set to "80" or smaller. As described above, by use of the ignition plug 101 according to Embodiment 1 of the present invention, as the ignition coil device 102, an ignition coil device can be adopted in which energy to be accumulated and released is current-oriented.

When the secondary current that flows in the secondary coil 102*b* of the ignition coil device 102 is increased, the secondary voltage generated across the secondary coil 102*b* becomes smaller; thus, in some of conventional ignition plugs having no pilot electrode, no dielectric breakdown can be caused in the main plug gap of the ignition plug 101, whereby extinction is caused. In order to increase both the secondary current in the ignition coil device 102 and the secondary voltage by use of a conventional ignition plug having no pilot electrode, a huge ignition coil device is required; thus, in terms of the cost and the capability of being mounted (mountability) in an internal combustion engine, the conventional ignition plug cannot be accepted as a product. In contrast, the ignition plug 101 according to Embodiment 1 of the present invention has the pilot electrode 101*c*; therefore, by utilizing the ignition plug 101 in the ignition device, a dielectric breakdown can securely be caused in the main plug gap while the cost and the mountability equivalent to a conventional ignition plug is maintained, and a large discharge current can be made to flow.

When a large discharge current flows in the main plug gap of the ignition plug 101, a large current flows also in a path from the secondary coil 102*b* of the ignition coil device 102 to the high-voltage electrode 101*a* of the ignition plug 101. Accordingly, if a large resistance component exists in this path, a large loss is caused. It is also conceivable that depending on the specification of the current-oriented ignition coil device 102, a shortfall in the generated voltage makes it impossible to make a current flow into the main plug gap of the ignition plug 101. Therefore, the resistance component of the path from the secondary coil 102*b* of the ignition coil device 102 to the high-voltage electrode 101*a* of the ignition plug 101 is required to be set as small as possible.

In general, in an ignition plug, as a filling material for connecting a high-voltage electrode with the terminal to be connected to the ignition coil device, a material having a large resistance component of approximately 5 [kΩ] is utilized in order to suppress noise; as described above, in terms of current supply, the resistance component of the filling material need to be reduced as large as possible. Thus, in the ignition plug 101 according to Embodiment 1 of the present invention, it is taken into consideration that the resistance value of the filling material 16 is 1 [kΩ] or smaller.

In order to form large discharge plasma in the main plug gap of the ignition plug 101, it is required to supply a "large current" to the main plug gap "repeatedly in a short time". The larger the current to be supplied to the main plug gap is, the more the plasma is formed. However, because the plasma concentrates in the vicinity of a discharging path, discharge plasma of a target size cannot be obtained only by increasing the discharge current. In order to distribute the generated plasma in a spatially wide area, it is required to generate a discharge twice or more times, i.e., so-called multiple discharge is required.

Due to a discharge caused in the main plug gap of the ignition plug 101, plasma is generated in the plug gap. When the discharge is interrupted, the plasma shows various behaviors; for example, part of it diffuses because of its own heat, another part of it flows due to the flow of the inflammable fuel-air mixture inside the combustion chamber of the internal combustion engine, and further another part of it is extinguished. In the case where when the foregoing discharge is interrupted, a predetermined high voltage is applied to the main plug gap in order to cause a discharge again in the main plug gap, the discharge is resumed in a less-impedance path in the main plug gap. The less-impedance path includes a path of high plasma density, a path that is shortest in the main plug gap, and so on; by implementing multiple ignitions, the probability that a discharge is caused again in a path different from the previous discharging path rises.

Because multiple ignitions cannot singly make it possible to generate sufficient plasma through a single discharge, no large discharge plasma can be formed as a whole; by merely increasing the discharge current, plasma supply area becomes narrow and hence no large discharge plasma can be formed. However, because the ignition plug 101 according to Embodiment 1 of the present invention has the pilot electrode 101*c* and can reduce the required voltage, a discharge current capable of forming sufficient plasma can be supplied; moreover, multiple ignition makes it possible to supply plasma in a repeated manner and from different positions, i.e., in a wide area; thus, larger discharge plasma can be formed.

Figure 3:
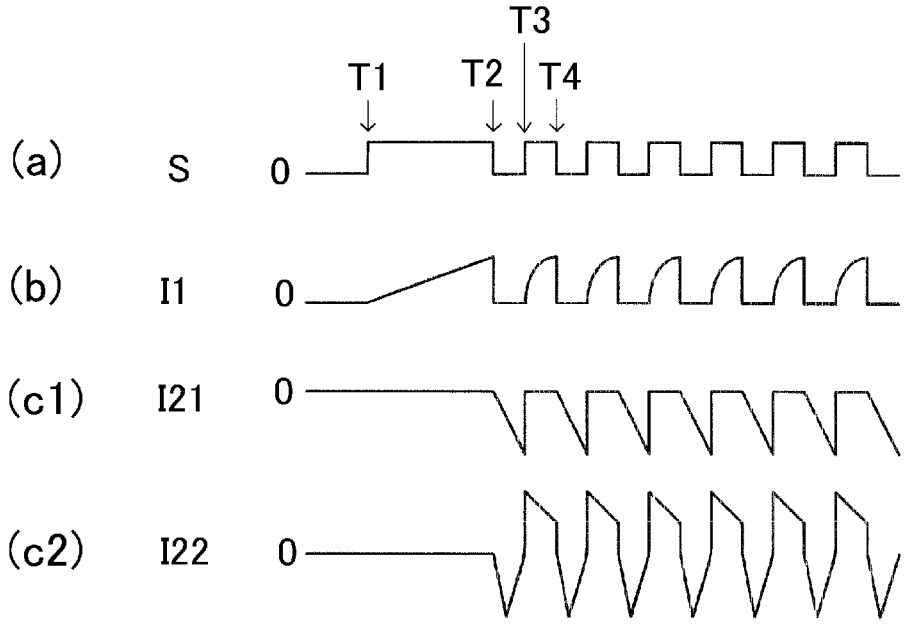
FIG. 3 is a timing chart for explaining the operation of an ignition apparatus according to Embodiment 1 of the present invention.

Next, there will be explained the operation of the ignition apparatus according to Embodiment 1 of the present invention. The signal generator 103*a* of the control apparatus 103 controls the switching device 103*b* formed of an IGBT in such a way that a discharge can be resumed in a cycle during which plasma produced in the main plug gap of the ignition plug 101 remains unextinguished and the formed plasma appropriately spreads. FIG. 3 is a timing chart for explaining the operation of the ignition apparatus according to Embodiment 1 of the present invention; FIG. 3(*a*) represents the waveform of the control signal S supplied to the switching device 103*b*; FIG. 3(*b*) represents the waveform of a primary current 11 that flows in the primary coil 102*a* of the ignition coil device 102; FIG. 3(*c*1) represents the waveform of a discharge current 121 that flows in the main plug gap in the case where the rectifier diode 102*d* is provided; and FIG. 3(*c*2) represents the waveform of a discharge current 122 that flows in the main plug gap in the case where the rectifier diode 102*d* is not provided.

In FIGS. 1 and 3, at first, when at the timing T1, the control signal S represented in FIG. 3(*a*) becomes high-level (referred to H-level, hereinafter), the switching device 103*b* turns on; then, as represented in FIG. 3(*b*), the primary current 11 starts to flow from the power source 100 to the GND, by way of the primary coil 102*a* of the ignition coil device 102 and the switching device 103*b*, and gradually increases. Due to the primary current 11 that flows in the primary coil 102*a*, the ignition coil device 102 accumulates magnetic energy.

When at the timing T2 after sufficient magnetic energy has been accumulated in the ignition coil device 102, the control signal S is turned to be low-level (referred to as L-level, hereinafter) so as to turn the switching device 103*b* off and to cut off the primary current 11, the high-voltage supply coil 102 releases the accumulated magnetic energy, so that a high voltage is generated across the secondary coil 102*b*. The high voltage generated by the ignition coil device 102 is transferred to the high-voltage electrode 101*a* of the ignition plug 101 by way of the rectifier diode 102*d*, so that a dielectric breakdown is caused in the auxiliary plug gap between the high-voltage electrode 101*a* and the pilot electrode 101*c* and then a pilot discharge is caused.

When a pilot discharge is caused in the auxiliary plug gap, the impedance in the main plug gap between the high-voltage electrode 101*a* and the external electrode 101*b* decreases. Then, when the impedance between the high-voltage electrode 101*a* and the external electrode 101*b* becomes lower than the impedance of the pilot discharge path, a dielectric breakdown is caused between the high-voltage electrode 101*a* and the external electrode 101*b*, and then a main discharge is caused in the main plug gap. As a result, as represented in FIG. 3(*c*1), the discharge current 121 starts to flow and gradually increases.

In Embodiment 1 of the present invention, the direction from the high-voltage electrode 101*a* of the ignition plug 101 to the external electrode 101*b* will be defined as the positive direction. When the ignition coil device 102 releases magnetic energy, a negative high voltage is applied from the secondary coil 102*b* to the high-voltage electrode 101*a*, and then the negative-direction discharge current 121, represented in FIG. 3(*c*1), flows.

After that, when at the timing T3, the level of the control signal S is changed to H level, the switching device 103*b* turns on, the primary current I1 starts to flow again, and magnetic energy is accumulated in the ignition coil device 102; concurrently, across the secondary coil 102*b*, there is induced an induction voltage having a polarity contrary to that thereof at a time when the magnetic energy is released.

In the time from the timing T3 to the timing T4, the secondary coil 102*b* generates a positive-direction voltage for the ignition plug 101; because the rectifier diode 102*d* is provided in the ignition coil device 102, the discharge current 121 flowing in the main plug gap is cut off, as represented in FIG. 3(*c*1). As described above, the time from the timings T3 and the timing t4 is a time during which a discharge current is interrupted and plasma spreads.

In addition, in the case where no rectifier diode 102*d* is provided in the ignition coil device 102, a discharge current 122 that flows in the main plug gap flows in both the positive and negative directions, as represented in FIG. 3(*c*2), and then becomes an alternating current. At the timing T3, because plasma has been produced in the main plug gap, the impedance in the main plug gap is low; thus, when the positive voltage is applied, a positive-direction discharge current 122, the direction of which is contrary to the direction of the discharge current 122 that has been flowing so far, flows in the main plug gap. At this time, the direction of the discharge current 122 turns from the negative direction to the positive direction and hence the discharge is once interrupted; therefore, also in this case, the foregoing discharge path is liable to change.

Next, when at the timing T4, the level of the control signal S is turned to the L level, the switching device 103*b* turns off and hence the primary current I1 is cut off, as represented in FIG. 3(*b*); in the same manner as described above, the ignition coil device 102 releases the accumulated energy, and then a discharge current having the negative direction flows in the main plug gap. After that, by repeating the foregoing operation in the time from the timing T2 to the timing T4, a discharge can be repeated while the discharging path is changed, whereby large discharge plasma can be produced.

In addition, it is not required that the time period from the timing T2 to the timing T3 where the control signal S is L-level is as long as the time period from the timing T3 to the timing T4 where the control signal S is H-level. The above condition applies to the time periods after the timing T4.

In the case where the rectifier diode 102*d* is provided, it is desirable to change the level of the control signal S from L level to H level at a timing when the value of the discharge current 121 represented in FIG. 3(*c*1) becomes the negative peak value, for example, at the timing T3, because in that case, more plasma can be emitted into space than other cases. The time in which the control signal S remains L-level while discharge is implemented in the main plug gap, for example, the time from the timing T2 to the timing T3 depends on the specification of the ignition coil device 102; for example, it is set to a fixed value of approximately 3 [μs]. In addition, it is required to change the level of the control signal S from H level to L level by the time plasma is completely extinguished. The plasma extinction time differs depending on the temperature inside a combustion chamber, the pressure, the kind of plasma, and the like; therefore, it is desirable to change it in accordance with the operation condition of the internal combustion engine; for example, it is set to a fixed value of approximately 1 [μs].

In contrast, in the case where no rectifier diode 102*d* is provided, it is desirable to change the level of the control signal S from L level to H level at a timing when the discharge current 122 represented in FIG. 3(*c*2) gradually decreases and becomes approximately zero, for example, at the timing T3, because in that case, more time in which plasma spreads into space can be obtained than other cases. In this case, the time in which the control signal S remains L-level and the time in which the control signal S remains H-level depend on the specification of the ignition coil device 102; for example, each of the time in which the control signal S remains L-level and the time in which the control signal S remains H-level is set to a fixed value of approximately 5 [μs].

As described above, unlike a conventional ignition apparatus that is configured in a complex and expensive manner, the ignition apparatus according to Embodiment 1 of the present invention can produce large discharge plasma without requiring any high-level matching and with the same configuration and cost as those of a common ignition apparatus, and can supply a great deal of plasma to a wide area inside the combustion chamber so as to facilitate the combustion reaction; therefore, the lean or diluted combustion limit region or the like can be expanded.

Embodiment 2

Figure 4:
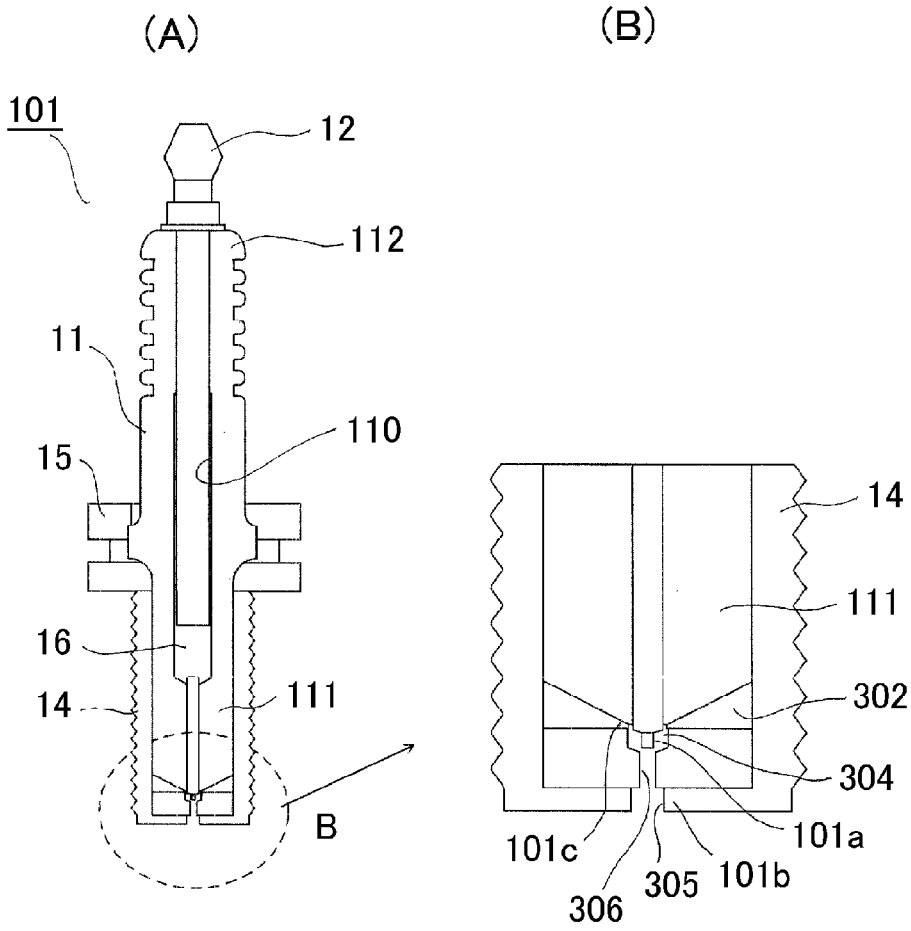
FIG. 4 is a set of cross-sectional views illustrating an ignition plug according to Embodiment 2 of the present invention.

Next, there will be explained an ignition plug of an ignition apparatus according to Embodiment 2 of the present invention. FIG. 4 is a set of cross-sectional views of an ignition plug according to Embodiment 2 of the present invention; FIG. 4(A) is a longitudinal cross-sectional view of the ignition plug; FIG. 4(B) is an enlarged cross-sectional view of B portion in FIG. 4(A). In FIG. 4, an ignition plug 101 is provided with an insulator portion 11 formed of an insulator such as ceramics or the like, a terminal portion 12 a filling material 16 having a resistance component, a high-voltage electrode 101*a*, as a first electrode, an external electrode 101*b*, as a second electrode, a high-voltage electrode 101*c*, as a third electrode, a screw portion 14, and a housing portion 15.

The insulator portion 11 is provided with a center hole 110; one end 111 and the other end 112 of the insulator portion 11 are formed in such a way as to have the same thickness. The terminal portion 12 is inserted into the center hole 110 of the insulator portion 11; one end of the terminal portion 12 is exposed from the other end 112 of the insulator portion 11. The high-voltage electrode 101*a* is inserted into the center hole 110 in the one end 111 of the insulator portion 11; one end of the high-voltage electrode 101*a* is exposed in a cavity 304 provided in the one end 111 of the insulator portion 11. The cavity 304 is narrowed by a narrow hole 306 formed in the one end 111 of the insulator portion 11.

The external electrode 101*b* is formed by bending the front end portion of the screw portion 14 by 90° toward the center of the screw portion 14. In the center portion of the external electrode 101*b*, there is formed an orifice 305 of a through-hole having a predetermined diameter. The high-voltage electrode 101*a* and the external electrode 101*b* face each other through a main plug gap formed of part of the cavity 304, the narrow hole 306, and part of the orifice 305.

The pilot electrode 101*c* is formed of an electric conductor 302 having a resistance component and is buried in the one end 111 of the insulator portion 11. The inner circumferential portion of the pilot electrode 101*c* is exposed in the inner wall of the cavity 304, surrounds the outer circumferential surface of one end of the high-voltage electrode 101*a*, and faces the high-voltage electrode 101*a* through an auxiliary plug gap, which is a predetermined gap. The outer circumference of pilot electrode 101*c* is electrically connected with the inner circumferential surface of the screw portion 14 and is electrically connected with the external electrode 101*b* by the intermediary of the screw portion 14. The auxiliary plug gap, which is a gap between the high-voltage electrode 101*a* and the pilot electrode 101*c*, is set in such a way that the pilot electrode 101*c* does not make contact with the high-voltage electrode 101*a* and in such a way as to be narrower than the main plug gap, which is the gap between the high-voltage electrode 101*a* and the external electrode 101*b*.

The other configurations are the same as those of the ignition plug according to Embodiment 1.

The ignition plug 101 according to Embodiment 2 is a plasma-jet ignition plug and generates, as described later, a large discharge current in the small cavity 304 so as to produce a great deal of plasma; because a great deal of plasma can be injected with directivity from the orifice 305 that is narrowed by the external electrode 101*b*, ignition can more effectively be implemented.

The ignition plug 101, configured in such a way as described above, according to Embodiment 2 of the present invention requires no dedicated external terminal for the pilot electrode 101*c* and can be utilized in such a way as to be directly connected with a normal ignition coil device.

Because the ignition plug 101 according to Embodiment 2 of the present invention has the pilot electrode 101*c*, the "required voltage", which is required for causing a dielectric breakdown in the main plug gap, can be reduced. In other words, assuming that a common ignition plug with no pilot electrode has a main plug gap whose gap size is the same as that of the ignition plug according to Embodiment 2 of the present invention, the ignition plug according to Embodiment 2 of the present invention can make it possible to lower the foregoing required voltage to a value as large as half of the required voltage for the common ignition plug.

It is ideal that the resistance value of the resistance component 101*d* that connects the pilot electrode 101*c* with the external electrode 101*b*, i.e., the resistance value of the resistance component of the electric conductor 302 that forms the pilot electrode 101*c* illustrated in FIG. 4 is determined in accordance with the foregoing required voltage that varies based on the operation status of the internal combustion engine; however, in that case, because an external terminal dedicated to the pilot electrode 101*c* is required, the structure of the ignition plug becomes complex. However, if the objective is limited to a restricted application such as reducing the maximum value of the foregoing required voltage in a common automobile equipped with an internal combustion engine utilizing gasoline as a fuel, the objective can be realized by setting the resistance value of the resistance component 101*d* to a fixed value of approximately 300 [kΩ]; thus, there can be demonstrated an effect that the required voltage for causing a dielectric breakdown in the main plug gap is lowered with a simple configuration.

If the objective is to lower the foregoing required voltage in the case where the ambient pressure inside the cylinder is lower than the atmospheric pressure, the objective can most efficiently be realized by setting the resistance value of the resistance component 101*d* to approximately 50 [kΩ]. If the objective is to lower the foregoing required voltage under a high-pressure condition where the ambient pressure inside the cylinder is the same as or higher than 10 atmospheres, the objective can be realized by setting the resistance value of the resistance component 101*d* to approximately 1 [MΩ].

Embodiment 3

For the purpose of forming large discharge plasma and supplying a great deal of plasma into a large area of the combustion chamber of an internal combustion engine, it is desirable to apply "a large current" to the plug gap "repeatedly in a short time". In Embodiment 1, the ignition coil device, as a current supply coil, is a so-called full-transistor type in which an ignition coil device is driven by a switching device formed of an IGBT, so that a simple and inexpensive ignition apparatus can be obtained. The full-transistor type according to Embodiment 1 is a system that places priority rather on "repeatedly in a short time" than "a large current" and that can perform a periodical drive at as high as 1 [MHz]; "repeatedly in a short time" and "a large current" are plasma supply conditions.

In contrast, in terms of supplying "a large current", it is desirable that the ignition coil device, as a current supply coil, is an ignition coil device based on a capacitive-discharge ignition method (referred to as a "CDI method", hereinafter). However, although being capable of supplying a large current, a common CDI method has a difficulty in supplying a current "repeatedly in a short time", because charging of a capacitor, which is the supply source of a capacitive current, requires a time of approximately several seconds.

An ignition apparatus according to Embodiment 3 of the present invention solves such a problem; in this ignition apparatus, an ignition coil device, as a current supply coil, is driven through a CDI method in which "a large current" can be supplied "repeatedly in a short time"; thus, a more high-performance ignition apparatus can be provided.

Figure 5:
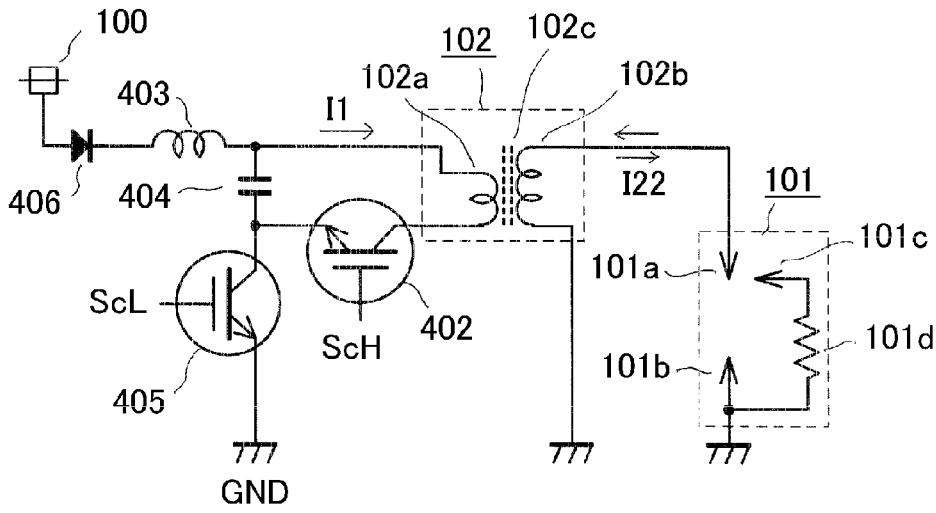
FIG. 5 is a configuration diagram of an ignition apparatus according to Embodiment 3 of the present invention.

FIG. 5 is a configuration diagram of an ignition apparatus according to Embodiment 3 of the present invention. In an ignition apparatus illustrated in FIG. 5, an ignition plug 101 is provided with a high-voltage electrode 101*a*, as a first electrode; an external electrode 101*b*, as a second electrode; and a pilot electrode 101*c*, as a third electrode. The ignition plug 101 may be either the ignition plug illustrated in FIG. 2 of Embodiment 1 or the ignition plug illustrated in FIG. 4 of Embodiment 2.

An ignition coil device 102 has a primary coil 102*a* and a secondary coil 102*b* that are magnetically coupled with each other through an iron core 102*c*. One end of the secondary coil 102*b* is connected with the high-voltage electrode 101*a* of the ignition plug 101, and the other end thereof is connected to the GND. An ignition capacitor 404 is connected across the primary coil 102*a* by way of a first switching device 401 formed of an IGBT. The positive electrode of the ignition capacitor 404 is connected with a power source 100 by way of the rectifier diode 406 and an inductor 403; the negative electrode thereof is connected with the GND by way of a second switching device 405 formed of an IGBT.

The first switching device 402 and the second switching device 405 are switching-controlled by a first control signal ScH and a second control signal ScL, respectively, from a signal generator (unillustrated) formed of an MPU (unillustrated). The signal generator sets the operation timing and the number of operations of the ignition coil device 102 in accordance with the operation status of an internal combustion engine, and generates the first control signal ScH and the second control signal ScL. The signal generator, the first switching device 402, and the second switching device 405 configure a capacitive current supply apparatus that supplies the primary coil of the ignition coil device 102 with a capacitive current based on electric charges accumulated in the ignition capacitor 404; the capacitive current supply apparatus forms part of a control apparatus that controls the operation of the ignition coil device 102.

A primary current I1 that flows in the primary coil 102*a* of the ignition coil device 102 is formed of a discharge current of the ignition capacitor 404 that flows in a discharging path that starts from the positive electrode of the ignition capacitor 404 and returns to the negative electrode of the ignition capacitor 404 by way of the primary coil 102*a*, and the collector and the emitter of the first switching device 402. Accordingly, as the electric-charge amount accumulated in the ignition capacitor 404 becomes larger, the value of the primary current I1 becomes larger. Therefore, by appropriately selecting a capacitance value C of the ignition capacitor 404 and the charging voltage thereof, a "large current" can be supplied.

The ignition capacitor 404 is charged through a charging path starting from the power source 100 and reaches the GND by way of the rectifier diode 406, the inductor 403, the positive electrode of the ignition capacitor 404, the negative electrode of the ignition capacitor 404, the collector of the second switching device 405, and the emitter of the second switching device 405, in that order.

Because the ignition capacitor 404 is connected with the power source 100 by way of the inductor 403, the charging current that flows from the power source 100 to the ignition capacitor 404 flows while being amplified in a so-called LC resonance cycle determined by the electrostatic capacitance value C of the ignition capacitor 404 and the inductance value L of the inductor 403. In other words, by appropriately selecting parameters including the inductance value L of the inductor 403 and the electrostatic capacitance value C of the ignition capacitor 404, the ignition capacitor 404 can be charged extremely rapidly and at a voltage higher than the voltage of the power source 1001; thus, plasma supply can be implemented "repeatedly in a short time".

In the ignition apparatus, configured as described above, according to Embodiment 3 of the present invention, when at a timing corresponding to the timing T1 in FIG. 3, the first control signal ScH from the unillustrated signal generator becomes H-level, the first switching device 402 turns on. At this time, the second control signal ScL (not represented in FIG. 3) from the signal generator is L-level and hence the second switching device 405 is off. When the first switching device 402 turns on, the discharge current of the ignition capacitor 404 that has been charged up to a voltage higher than the voltage of the power source 100 flows, as the primary current, into the ignition coil device 102 through the discharging path.

Next, when at a timing corresponding to the timing t2 in FIG. 3, the first control signal ScH turns to L level, th first switching device 402 turns off and hence the primary current from the ignition capacitor 404 is cut off; concurrently, the second control signal ScL becomes H-level, and the second switching device 405 turns on. When the second switching device 405 turns on, the ignition capacitor 404 is rapidly charged up to a voltage higher than the voltage of the power source 100, based on the LC resonance through the foregoing charging path.

After a timing corresponding to the timing T2 in FIG. 3, the first control signal ScH and the second control signal ScL alternately turn on or off in a short time between the timing T3 and T4, whereby the first switching device 402 and the second switching device 405 alternately turn on or off, as described above; as a result, the primary current of the ignition coil device 102 flows repeatedly in a short time. In Embodiment 3 illustrated in FIG. 5, no rectifier diode is connected with the secondary coil 102*b* of the ignition coil device 102; thus, the secondary current 122, which is produced because the first switching device 402 repeatedly turns on or off, flows as an alternating current, as represented in FIG. 3(*c*2). The operation of the ignition plug 101 connected with the secondary coil 102*b* of the ignition coil device 102 is the same as that of Embodiment 1 or Embodiment 2.

During ignition operation after the timing T1, the first control signal ScH and the second control signal ScL are outputted from the signal generator in the control apparatus in such a way that when one of them is H-level, the other one becomes L-level; as a result, the first switching device 402 and the second switching device 405 are switching-controlled in such a way that when one of them is on, the other one becomes off.

The foregoing CDI-method ignition apparatus according to Embodiment 3 of the present invention makes it possible to implement periodical drive at a frequency of as high as 100 [kHz]. The full-transistor ignition apparatus according to Embodiment 1 can also increase the value of a current to be dealt with; however, in the case of the CDI-method ignition apparatus, because in particular, the current to be dealt with becomes large, the current may become a noise source to the environment, depending on the product structure or the mounting condition; thus, it is desirable to select an operation frequency out of the radio frequency band.

As described above, in the ignition apparatus according to Embodiment 3 of the present invention, a larger primary current can flow repeatedly in a short time in the primary coil of the ignition coil device; therefore, a further larger current can be applied to a discharging path of the main plug gap. Accordingly, large discharge plasma is formed so that a great deal of plasma can be supplied to the wide area of the combustion chamber of an internal combustion engine so as to facilitate the combustion reaction; therefore, the lean combustion or the lean combustion limiting region and the like can be expanded.

The ignition apparatus, described above, according to each of Embodiments 1 through 3 of the present invention is mounted in an automobile, a motorcycle, an outboard engine, an extra machine, or the like utilizing an internal combustion engine, and is capable of securely igniting a fuel; therefore, the ignition apparatus makes it possible to effectively operate the internal combustion engine, and hence contributes to the environment preservation and to the solution of the problem of fuel depletion.

Various modifications and alterations of this invention will be apparent to those skilled in the art without departing from the scope and spirit of this invention, and it should be understood that this is not limited to the illustrative embodiments set forth herein.

What is claimed is:

1. An ignition apparatus comprising:

an ignition plug that causes a spark discharge for igniting a fuel;

an ignition coil device that supplies the ignition plug with energy for causing the spark discharge; and a control apparatus that drives the ignition coil device, wherein the ignition plug includes a first electrode that generates a high voltage by means of energy supplied by the ignition coil device, a second electrode that faces the first electrode through a first gap and causes in the first gap a spark discharge for igniting the fuel, and a third electrode that faces the first electrode through a second gap that is smaller than the first gap, an electric conductor having a predetermined resistance value directly connected to the third electrode and the second electrode;

and the control apparatus drives the ignition coil twice or more times in a single ignition process.

2. The ignition apparatus according to claim 1, wherein the ignition coil device includes a primary coil and a secondary coil, and the turn ratio of the secondary coil to the primary coil is 80 or smaller.

3. The ignition apparatus according to claim 1, wherein in the ignition plug, the resistance value of a path from a terminal where the ignition plug is connected with the ignition coil device to the first electrode is set to 1 [k□] or smaller.

4. The ignition apparatus according to a claim 1, wherein the ignition plug is configured in such a way that plasma produced by a discharge in a cavity formed between the first electrode and the second electrode is ejected to the outside from an orifice provided in the second electrode.

5. The ignition apparatus according to claim 1, wherein the control apparatus has a capacitive current supply apparatus for supplying the primary side of the ignition coil device with a capacitive current based on electric charges accumulated in a capacitor so that the capacitive current makes the ignition coil device operate two or more times in a single ignition process.

6. The ignition apparatus according to claim 5, wherein the ignition coil device includes a primary coil and a secondary coil, and the turn ratio of the secondary coil to the primary coil is 80 or smaller.

7. The ignition apparatus according to claim 5, wherein in the ignition plug, the resistance value of a path from a terminal where the ignition plug is connected with the ignition coil device to the first electrode is set to 1 [k□] or smaller.

8. The ignition apparatus according to claim 5, wherein the ignition plug is configured in such a way that plasma produced by a discharge in a cavity formed between the first electrode and the second electrode is ejected to the outside from an orifice provided in the second electrode.

* * * * *